US007909658B2

(12) United States Patent
Pfaffenbach

(10) Patent No.: US 7,909,658 B2
(45) Date of Patent: Mar. 22, 2011

(54) PLUG FOR PHOTOVOLTAIC CONNECTOR CABLE

(75) Inventor: Dirk Pfaffenbach, Halver (DE)

(73) Assignee: Lumberg Connect GmbH, Schalksmuehle (DE)

( * ) Notice: Subject to any disclaimer, the term of this patent is extended or adjusted under 35 U.S.C. 154(b) by 0 days.

(21) Appl. No.: 12/593,012

(22) PCT Filed: Jan. 11, 2008

(86) PCT No.: PCT/DE2008/000049

§ 371 (c)(1), (2), (4) Date: Sep. 25, 2009

(87) PCT Pub. No.: WO2009/076916

PCT Pub. Date: Jun. 25, 2009

(65) Prior Publication Data

US 2010/0240242 A1 Sep. 23, 2010

(30) Foreign Application Priority Data

Dec. 15, 2007 (DE) ..... 10 2007 060 573

(51) Int. Cl.
*H01R 13/64* (2006.01)

(52) U.S. Cl. ..... 439/680; 439/252; 439/133

(58) Field of Classification Search ..... 439/133, 439/252, 304, 680

See application file for complete search history.

(56) References Cited

U.S. PATENT DOCUMENTS

| | | | | |
|---|---|---|---|---|
| 4,076,361 | A | 2/1978 | Campbell | 339/75 |
| 4,239,325 | A | 12/1980 | Tyson | 339/89 |
| 6,296,508 | B1 | 10/2001 | Kuwahara et al. | 439/353 |
| 7,326,091 | B2 * | 2/2008 | Nania et al. | 439/681 |
| 7,422,466 | B1 * | 9/2008 | Arai | 439/353 |
| 7,661,995 | B2 * | 2/2010 | Nania et al. | 439/681 |
| 2010/0240242 | A1 * | 9/2010 | Pfaffenbach | 439/353 |

FOREIGN PATENT DOCUMENTS

| | | |
|---|---|---|
| EP | 0549386 | 6/1993 |
| WO | WO 2007073962 | 7/2007 |

* cited by examiner

*Primary Examiner* — James Harvey

(74) *Attorney, Agent, or Firm* — Andrew Wilford

(57) ABSTRACT

The invention relates to a plug connector (1*c*) with a plug (11) which has a handle element (13) which has at least one snap-in unit (19) and one contact support (14) oriented in the plug-in direction (X), and with a bushing (12) whose handle element (40) forms a contact support holder (45) and an opposing snap-in means (44) corresponding to the snap-in means, said opposing snap-in means cooperates with the snap-in means to secure the plug and the bushing in the connected state, wherein the contact support (14) and the contact carrier holder (45) form mutually corresponding positioning means (23, 49) which allow insertion of the plug into the bushing only with the snap-in means facing the opposing snap-in means. The problem of the invention is to create a plug connector which improves in particular the blind insertion of plug and bushing and thus improves the ease of assembly. This problem is solved by a plug connector with the characterizing features, such that one of the positioning means of the plug or bushing has a guide section (27) which cooperates with an opposing guide section (57) of the bushing or plug, so that during the plugging process, both plug and bushing are forced to move relatively toward each other to attain the corresponding position of the positioning means (23, 49).

13 Claims, 11 Drawing Sheets

PLUG FOR PHOTOVOLTAIC CONNECTOR CABLE

CROSS REFERENCE TO RELATED APPLICATIONS

This application is the US national phase of PCT application PCT/DE2008/000049, filed 11 Jan. 2008, published 25 Jun. 2009 as WO2009/076916, and claiming the priority of German patent application 102007060573.2 itself filed 15 Dec. 2007, whose entire disclosures are herewith incorporated by reference.

FIELD OF THE INVENTION

The invention concerns a plug-type connector, particularly for photovoltaic connector cables, with a plug having a grip, at least one snap formation effective in a plug-in direction, and a contact holder, and with a socket having a grip forming a contact-holder seat and an opposite snap formation that cooperates with the one snap formation and that together with the one snap formation secures the plug and the socket in a plugged-in condition, the contact holder and the contact-holder seat being formed with complementary positioning means that make insertion of the plug into the socket only possible when the one snap formation is aligned with the opposite snap formation.

BACKGROUND OF THE INVENTION

Generic plug-type connectors have been used by applicant in obvious prior public use for some time in the area of photovoltaic connection technology. These are single-pole plug-type connectors with which cables are connected that conduct electricity from solar panels. For safety reasons, the plug and socket of the plug-type connector have snap formations that are designed on the plug as two snap-in tongues and on the socket as snap seats that cooperate with the snap-in tongues.

In order to ensure during installation that in the plug-in process, the plug can be inserted into the socket only with the snap-in tongues fitting with the snap seats, the plug and socket are provided with positioning means.

In a specific embodiment, the socket has an essentially cylindrical contact-holder seat that has two inwardly projecting insets located diametrally opposite each other offset by approximately 180° relative to the plug-in direction that decrease the inner cross-sectional area of the contact-holder seat by forming secantal faces.

An essentially cylindrical contact-holder seat that is oriented in the plug-in direction has cut-outs that are complementary to the insets of the socket, so that the plug can only be introduced into the socket when the secantal faces on the plug and on the socket are aligned with each other. This orientation that ensures the snap-in process in the plug-type connector of plug and socket is particularly advantageous in the assembly in positions that are difficult to access. Thus, the plug-in process can take place blind, a safe orientation of the snap formations toward each other being ensured without exception.

The described plug-type connector has been tested many times, however, with respect to its handling, it is seen as being in need of improvement.

OBJECT OF THE INVENTION

The object of the invention is to provide a plug-type connector that especially improves the plug-in of plug and socket without having to be observed and thus significantly improves the ease of installation.

SUMMARY OF THE INVENTION

This object is attained by a plug-type connector wherein one of the positioning means of the plug or socket is provided with a guide formation that works together with an opposite guide formation of the socket or plug so that during the plug-in process the plug and socket are forced to move relative to each other to assume the aligned position of the positioning means. In the prior art, specifically a plugging process for positioning means that are not aligned toward each other, such as for example, the previously described secantal faces, was not possible. In order to make the plugging process possible, however, the positioning means had to be aligned with each other as a result of active relative rotation of the plug and socket by the installer. Only then was it possible to establish a plug-in connection.

The necessity of an active alignment of the positioning means toward each other is eliminated by the guide formations according to the invention. If plug and socket are put together with positioning means that are not aligned with each other, the one guide formations and opposite guide formations work together in such a way that at the start of the plug-in motion, the plug and socket automatically align with each other in such a way that the positioning means are in aligned position. A to and fro motion of plug or socket by the installer is thus eliminated, the correct alignment of plug and socket takes place automatically in the plug-in process as a result of the forced guiding initiated by the guide formations and opposite guide formations. This makes installation of the plug-type connector in accordance with the invention immensely easier, particularly when plug-in is performed without benefit of vision.

It is conceivable that the positioning means of the contact-holder seat is designed as at least one inset oriented in the plug-in direction that reduces the area or the horizontal cross section and that the contact holder has at least one cut-out complementary to the inset, and for positioning of snap formations and opposite snap formations the inset and cut-out face each other during the plug-in process, particularly when the inset forms a secantal face with respect to the contact-holder seat and the cut-out forms a secantal face with respect to the contact holder and for positioning of snap-in and opposite snap formation, the secantal faces of contact holder and contact-holder seat face each other.

The at least one inset has a front end face that confronts the contact holder that is provided with an angled opposite face that is angled relative to the plug-in direction and that the outer-surface region bordering on the at least one cut-out on the contact holder is provided with an angled guide edge, and that the angled guide edge and the angled opposite face work together like a thread during the plug-in process and the plug and the socket are forced to rotate relative to each other up to the aligned position of inset and cut-out.

The previously described plug-type connector basically uses the positioning means that are already known from the prior art. On the inset, only the shape of the front end face that was already available in the prior art was modified. This does not affect the inner areas of the cylindrical contact holder.

The angled guide edge on the contact holder must consequently be designed in such a way that the outer circumference of the contact holder is not expanded. The angled guide edge is therefore realized by a corresponding material removal, the outer circumference of the contact holder being partially reduced. In the transition section, the contact holder forms a shoulder that forms the angled guide edge.

In other words, the angled guide edges and angled opposite faces or, formulated more abstractly, the one guide formations and opposite guide formations do not have an effect on the geometric congruence of contact holder and contact-holder seat of the prior art, so that the new plug-type connector is plug-in compatible with the existing plug-type connector of the applicant. With respect to service and maintenance of existing photovoltaic connector cables or the extension of existing installations, this is a significant advantage, as no components of older plug-type connectors have to be exchanged or adapted.

A preferred embodiment is characterized in that it is provided with a contact holder that is offset by approximately 180° at the circumference relative to positioning means located toward each other in the form of insets that work together with corresponding cut-outs on the contact-holder seat.

When using two insets arranged corresponding to each other, the maximal path of rotation of plug and socket toward each other can be limited up to the aligned position of inset and cut-out to a maximum of approximately 180°.

In a particularly preferred embodiment, the plug-type connector is developed further so that each inset has a front end face that confronts the contact holder, that is provided with two angled opposite faces that are directed toward each other roof-shaped, sloping in the plug-in direction, and that each outer-surface region bordering on the at least one cut-out on the contact holder is provided with two angled guide edges oriented arrow-like toward each other in the plug-in direction, and respectively one angled guide edge and one opposite angled edge that work together in the plug-in process like a thread and force the plug and socket to rotate relative to each other into the aligned position of inset and cut-out. By means of two angled guide edges with complementarily angles, rotation in two directions is possible. Additionally, when using two positioning means that are offset with respect to each other at the circumference by approximately 180°, the maximum rotation path is shortened to 90°.

BRIEF DESCRIPTION OF THE DRAWING

Additional advantages of the invention as well as a better understanding follow from the description of preferred embodiments in conjunction with the drawings. Therein.

SPECIFIC DESCRIPTION

Figure 2:
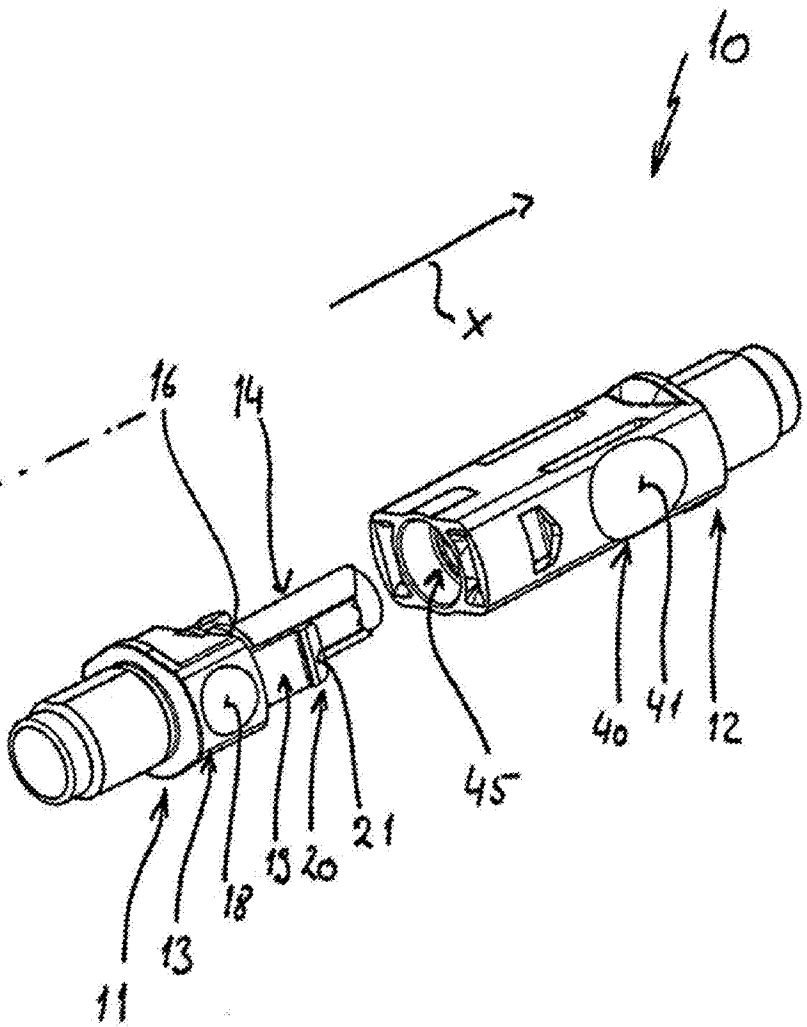
FIG. 2 shows a plug-type connector according to FIG. 1 in unplugged condition.

In the figures, a plug-type connector is identified throughout at 10. The plug-type connector comprises a plug 11 and a socket 12. FIGS. 1 to 15 show the plug-type connector in accordance with the invention or its plug 11 and socket 12 in various views, whereas FIGS. 16 to 21 show a plug 11 and a socket 12 according to the prior art as they have previously been sold by applicant.

The drawings illustrating the prior art and those of the plug-type connector 10 according to the invention show analogous construction components with identical references. In the following, first, the prior art according to FIGS. 16 to 19 will be discussed.

The plug 11 of the plug-type connector 10 from the prior art comprises a grip 13 from which a central, essentially cylindrical tubular contact holder 14 extends in a plug-in direction x. Adjacent a contact-support base 15, two annular ridges 16 are located spaced from each other in the plug-in direction to form a groove 17 for a gasket, particularly an unillustrated O-ring.

From the grip 13, which is provided with two opposite recessed grip recesses 18 further extend two opposite snap-in tongues 19 that flank the contact holder 14 and whose outer ends 20 point in the plug-in direction and are provided with snap barbs 21 that are wedge-shaped in the plug-in direction x and tapered toward the contact holder 14.

The contact holder 14 is essentially a cylindrical tube having a central bore 22 holding an unillustrated contact. At two opposite sides, the contact holder 14 is formed with cut-outs 23 as a result of material removal that serve as positioning means for the contact holder. As a result of the cut-outs 23, the otherwise cylindrical contact holder 14 has secantal faces 24 that extend from the last ridge in the plug-in direction x up to a—in the plug-in direction x—contact-support outer end 25. The secantal faces 24 each primarily point toward a respective one of the snap-in tongues 19.

Figure 19:
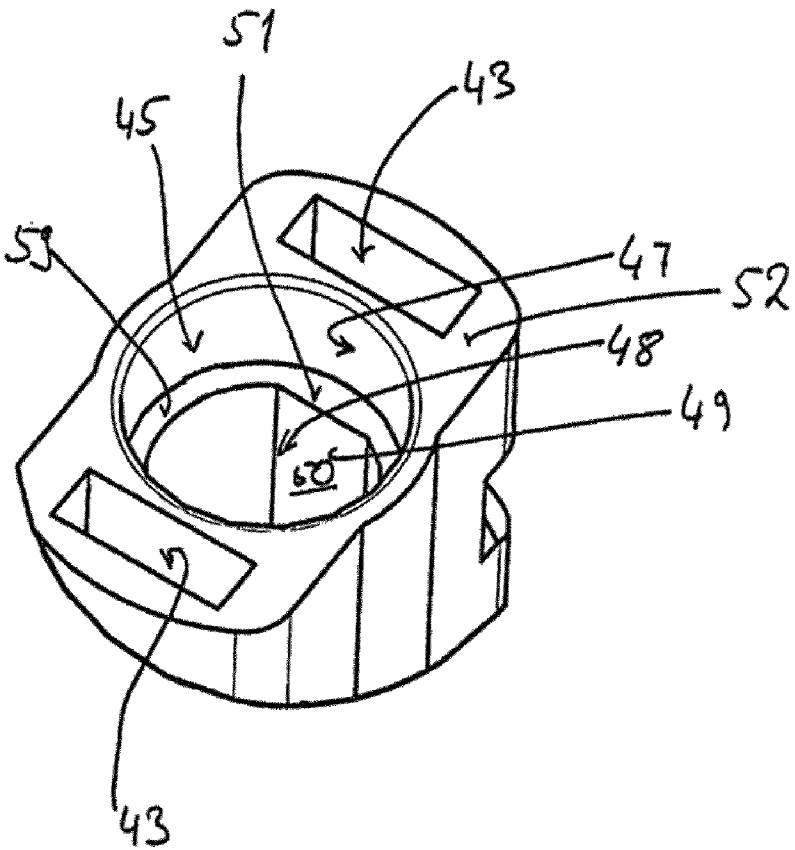
Fig. 19 Prior Art
FIG. 19 is a large-scale view of the detail indicated at circle XVIII in FIG. 18.
Figure 18:
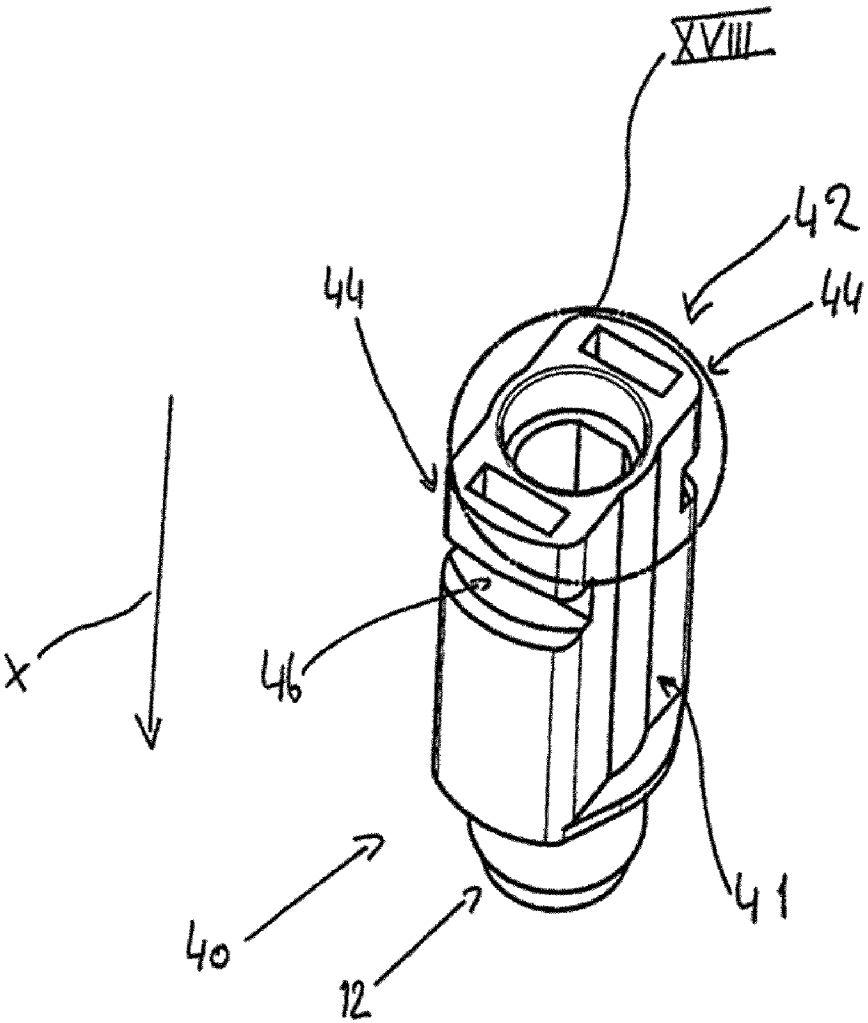
Fig. 18 Prior Art
FIG. 18 shows a socket of a plug-type prior-art connector.

In FIGS. 18 and 19, views of the socket 12 of the prior art are shown. Here the socket 12 is also provided with a grip identified at 40 and provided with two grip recesses 41 that are opposite each other. An outer end 42 of the socket 12 that is forward in the plug-in direction x has a front end face 52 at which open holes 43 of snap seats 44 that cooperated with the snap-in tongues on the plug. The snap seats 44 are opposite each other and flank a generally cylindrical contact-holder seat 45 formed by the grip 40 of the socket 12.

The snap seats 44 end in the respective slots 46 that are oriented perpendicular to the plug-in direction x, in which in plugged-in condition—engaging behind the respective snap seat 44—the snap barbs 21 of the plug 11 are held to lock the plugged-in condition.

The contact-holder seat 45 has two parts. Forward in the plug-in direction x it forms a sealing part 47 that merges with a somewhat narrower seat 48 for the contact holder 14.

The seat 48 extends in the plug-in direction x into the grip 40 of the socket 12 and has two insets 49 that are located opposite each other. The insets 49 form relative to the cylindrical horizontal cross section of the seat 48 secantal faces 50 that extend along the entire plug-in direction x the full length of the seat 48 and that are parallel to each other. The secantal faces 50 of the insets 49 are each positioned opposite a respective one of the snap seats 43.

Figure 21:
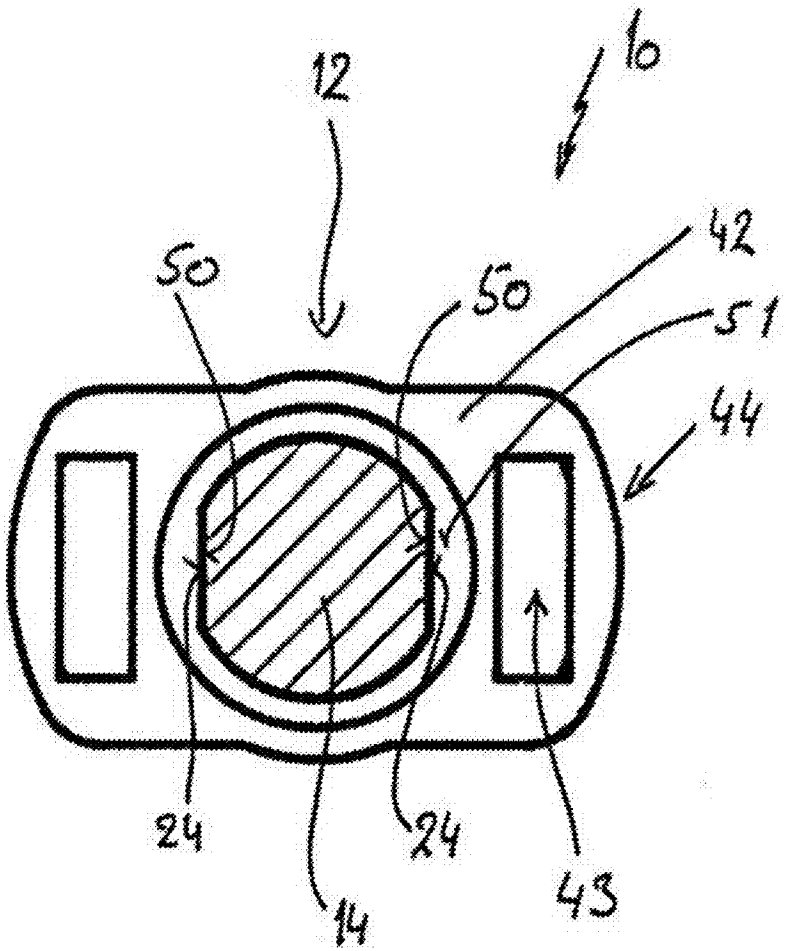
Fig. 21 Prior Art
FIG. 21 is a cross section like FIG. 20 with aligned positioning means of the contact holder and contact-holder seat.

In FIG. 21, a cross section of the plug-type connector 10 is shown. The cross-section plane is parallel to the front end face 52 of the socket 12 and is located in the joint between the plug 11 and the socket 12. FIG. 21 is shown simplified to the extent that the snap-in tongues 19 of the plug 11, as well as the annular ridge 16 of the plug 11 are not shown. With respect to the plug, only the contact holder 14 that is in seat 48 is shown.

As can easily be seen in FIG. 21, the plug 11 can only be inserted into the socket 12 when the secantal faces 24 and 50 of the contact holder 14 and the seat 48 are aligned with each other. During the plug-in process, the secantal faces 24 and 50 slide on each other. In the prior art, the secantal faces 24 and 50 of the cut-outs 23 and the insets 49 thus serve as positioning means that only permit plugging-in when the snap-in tongues 19 are aligned with the snap seats 44. This ensures that even when plugging in without looking, the snap formations 44 and 19 engage with each other upon at the end of the plug-in process and lock in the plugged-in condition of the plug-type connector 10.

Figure 20:
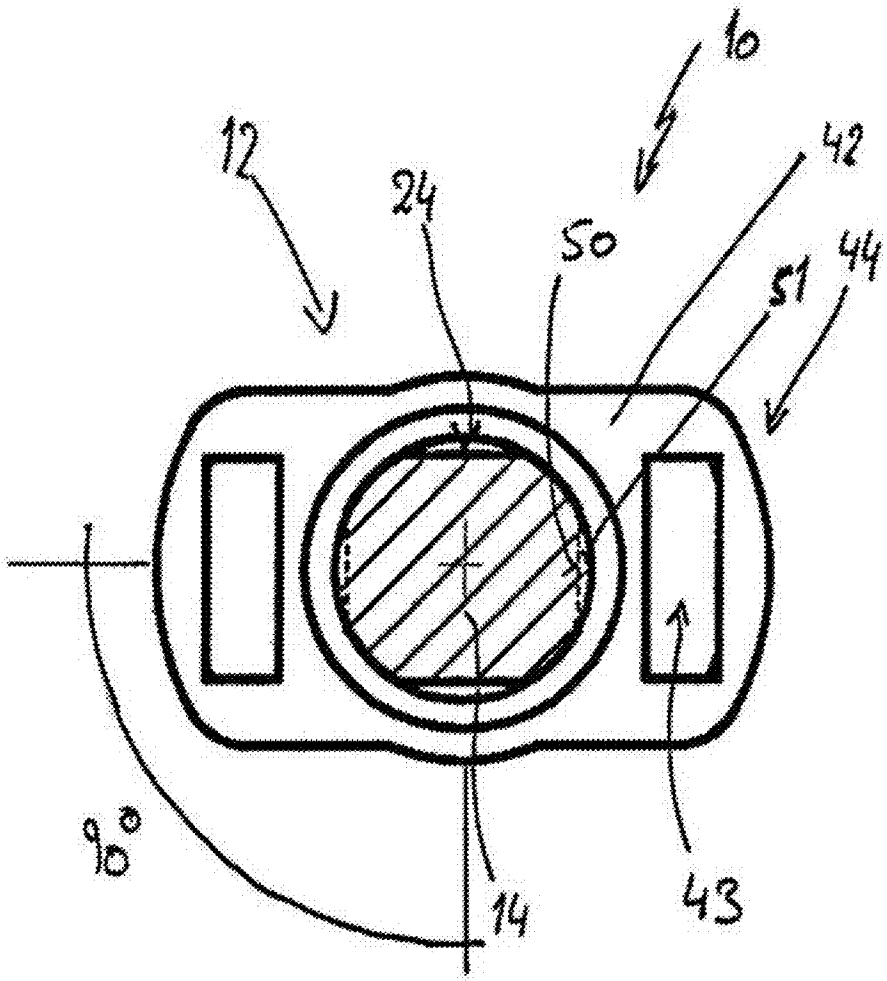
Fig. 20 Prior Art
FIG. 20 is a cross section through a plug-type prior-art connector with a view in the plug-in direction of the socket and positioning means of the contact holder and contact-holder seat offset with respect to each other by 90°.

FIG. 20 also shows a cross-sectional view of the prior-art plug-type connector 10 on a section plane that is identical to that in FIG. 21. In this orientation of the secantal faces 24 of contact holder 14 relative to the secantal faces 50 (shown as dotted line) of the seat 48, the plug 11 is in a position that is offset by 90° with respect to socket 12. In this position, front end faces 51 extending parallel to the confronting faces 52 of the socket 12 at the insets 43 prevent entry of the contact holder 14 into the seat 48. The plug-in process can thus not be concluded.

In this and in every other case, so long as the secantal faces 24 and 50 are not congruent or aligned to each other, the installer who is putting together the plug-type connector 10 must relatively rotate the plug 11 and the socket 12 around a longitudinal plug-connector axis L until the congruent position of the secantal faces 24 and 50 is found. Only then can the contact holder 14 be inserted into the seat 48 and the plug-in process can be completed.

FIGS. 20 and 21 show in particular how the position shown in all the figures of the secantal faces 24 and 50 that are designed as positioning means is not decisive relative to the snap formation designed as snap seat 44 or snap-in tongue 19 for the forced alignment toward each other of plug and socket. Rather, it is critical that the relative position of the positioning means of the plug or the socket are identical with the plug or socket snap formation in plug 11 and socket 12.

The invention is explained in the following with reference to FIGS. 1 to 15. The embodiment of the plug-type connector 10 according to the invention is identical with the previously described prior art in many characteristics and construction components. To that extent, the repetition of a basic description of the plug-type connector 10 with plug 11 and socket 12 is dispensed with and reference is made to the above explanations concerning the prior art.

Figure 1:
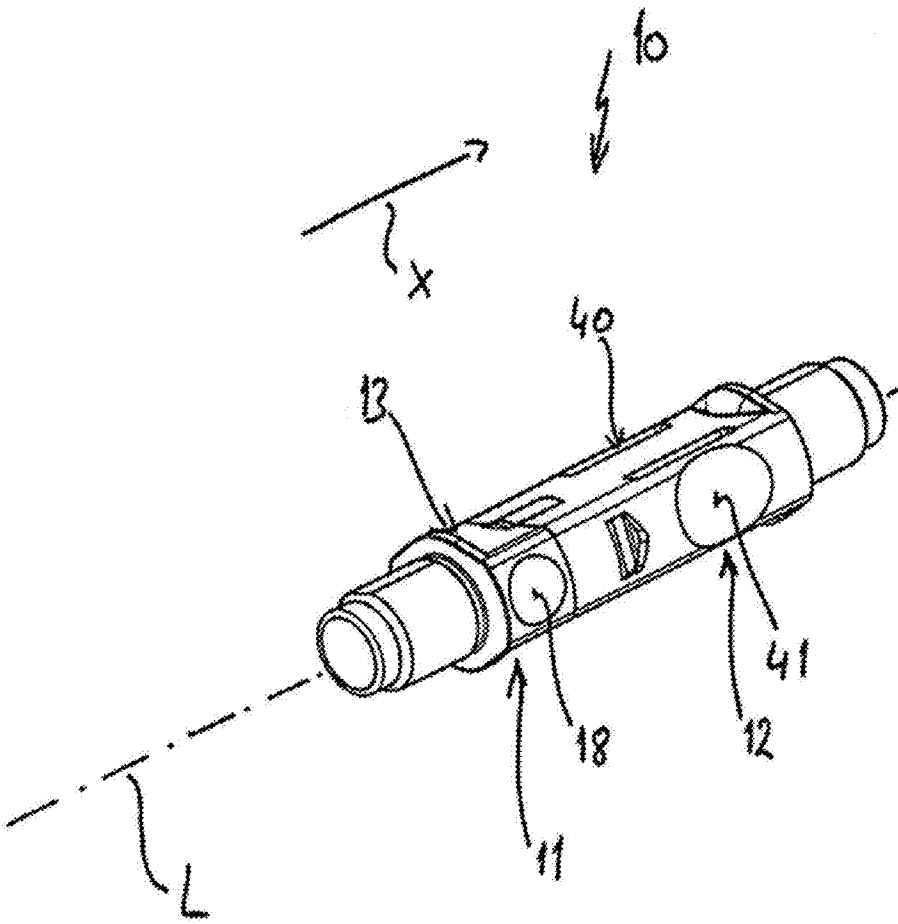
FIG. 1 shows a plug-type connector in accordance with the invention in plugged-in condition.

FIG. 1 shows a plug-type connector 10 according to the invention in plugged-in condition, in FIG. 2 it is shown in unplugged condition. The longitudinal plug-connector axis L that is shown in FIG. 1 for the first time and which is, however, analogous to the prior art, extends through the center of the plug-type connector 10 and is parallel to the plug-in direction x.

Figure 4:
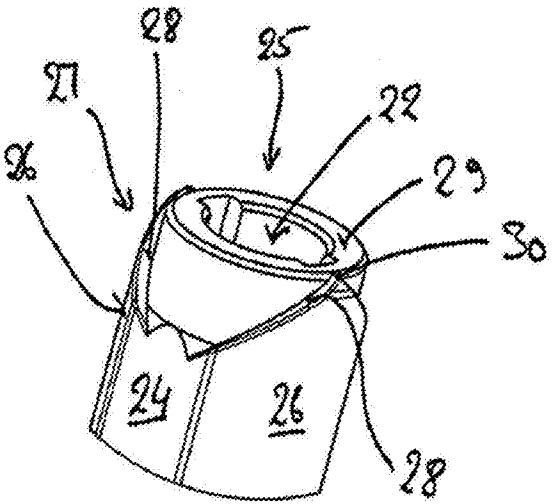
FIG. 4 is a large-scale view of the detail indicated at circle III in FIG. 3.
Figure 3:
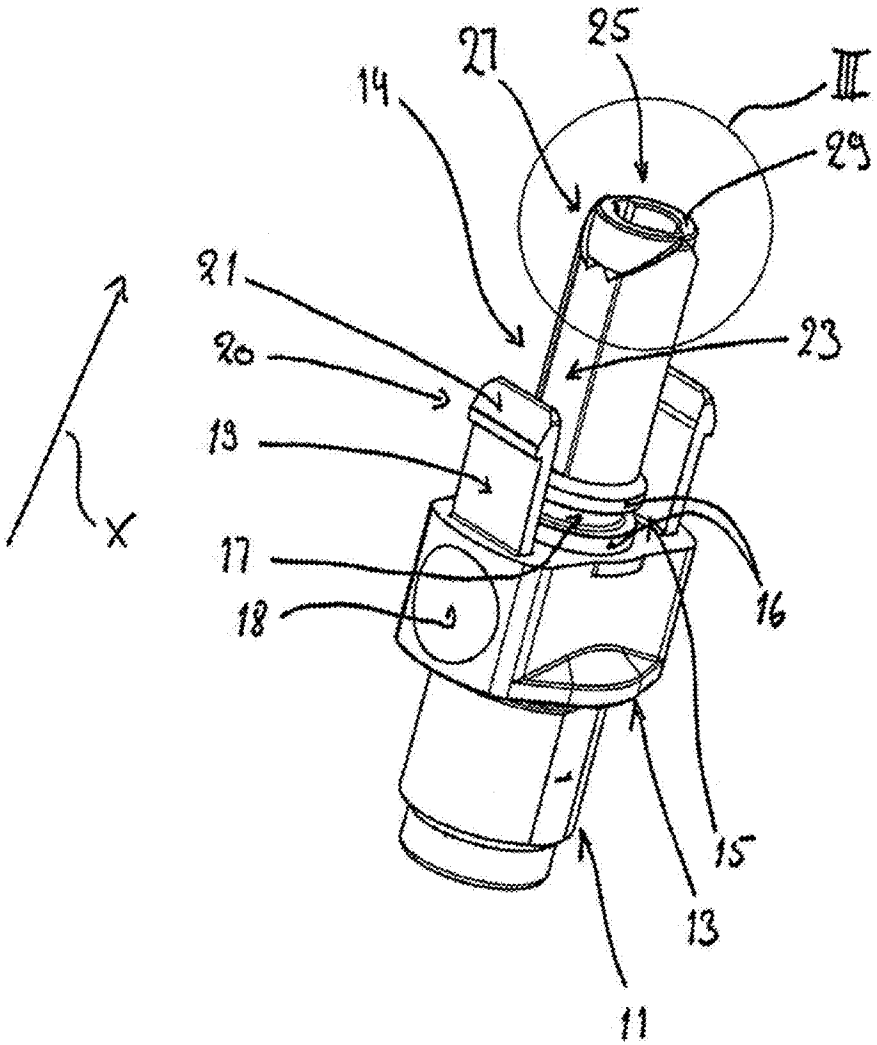
FIG. 3 is a detail view of the plug shown in FIG. 2.
Figure 6:
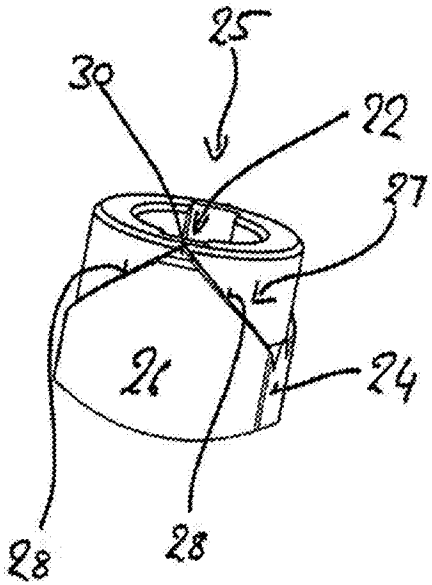
FIG. 6 is a large-scale view of the detail indicated at circle V in FIG. 5.
Figure 5:
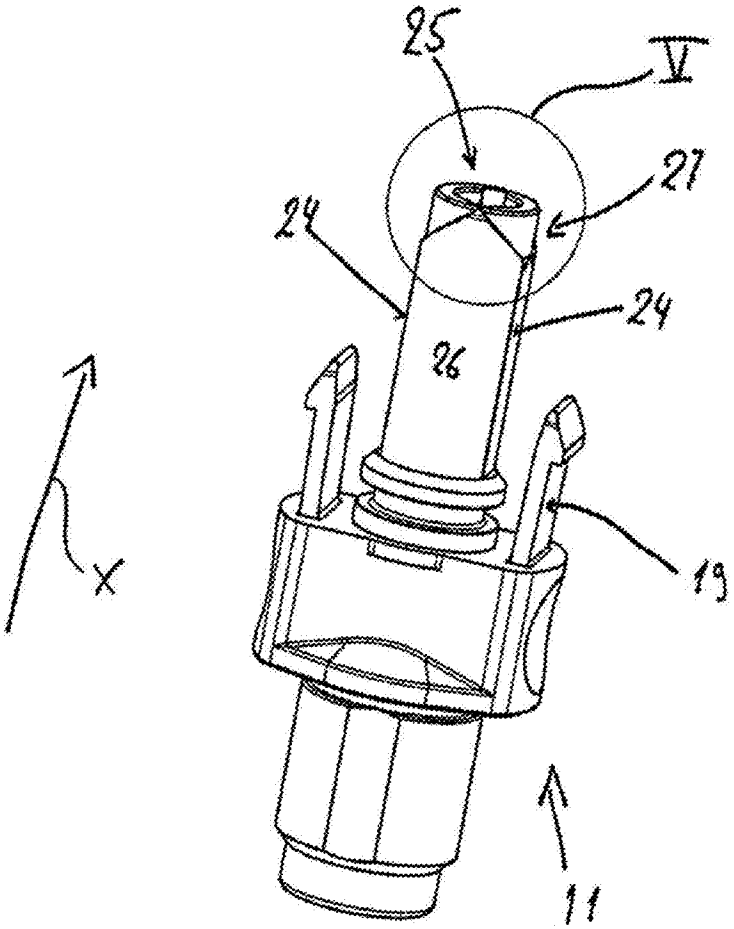
FIG. 5 shows the plug of FIG. 3 in an alternative view.
Figure 8:
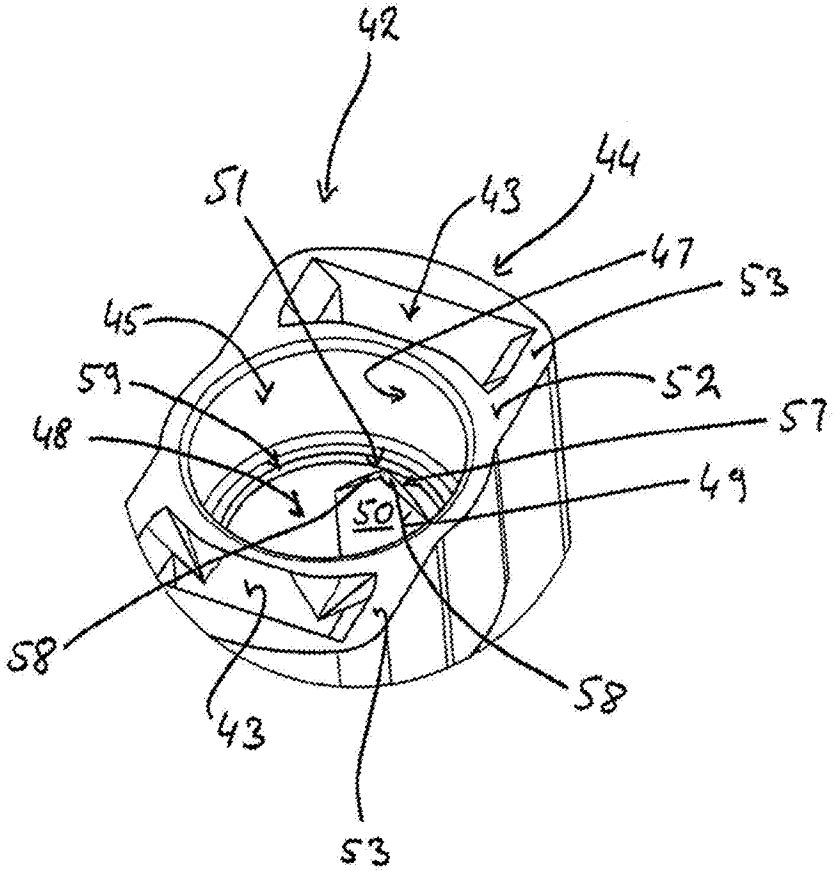
FIG. 8 is a large-scale view of the detail indicated at circle VIII in FIG. 7.
Figure 7:
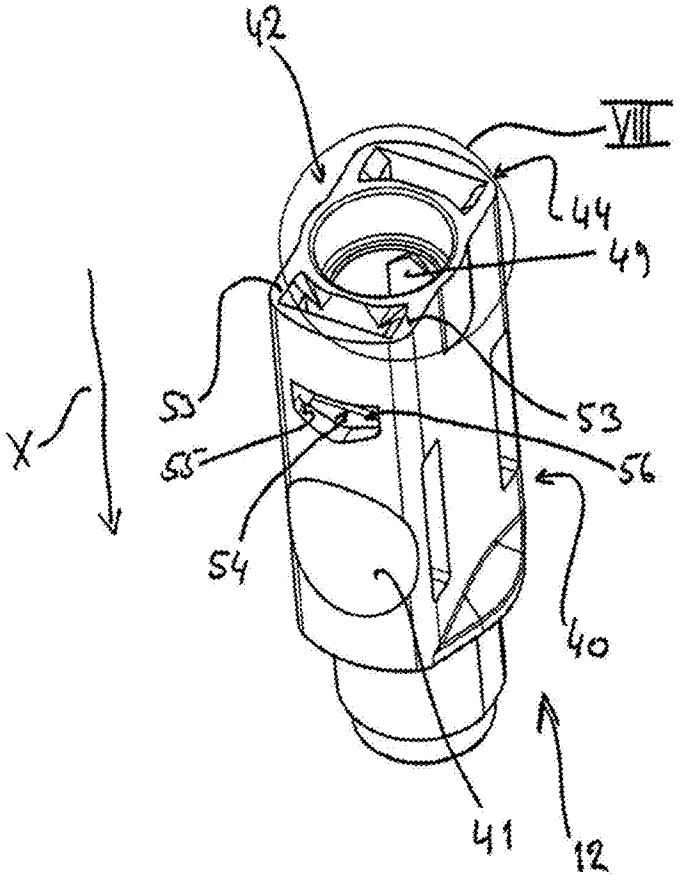
FIG. 7 is a detailed view of the socket according to FIG. 2.
Figure 10:
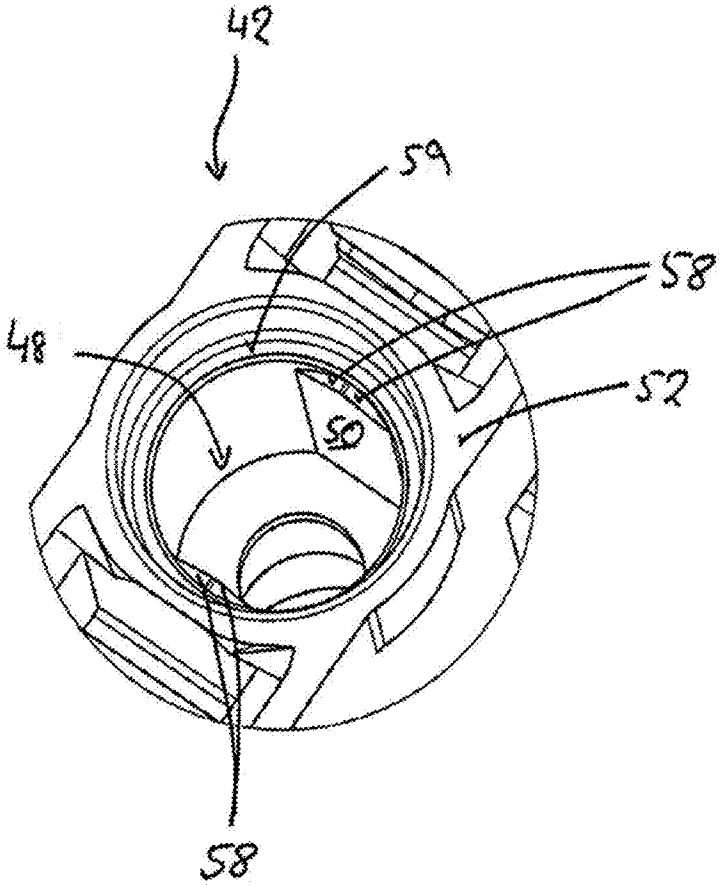
FIG. 10 is a large-scale view of the detail indicated at circle IX in FIG. 9.
Figure 9:
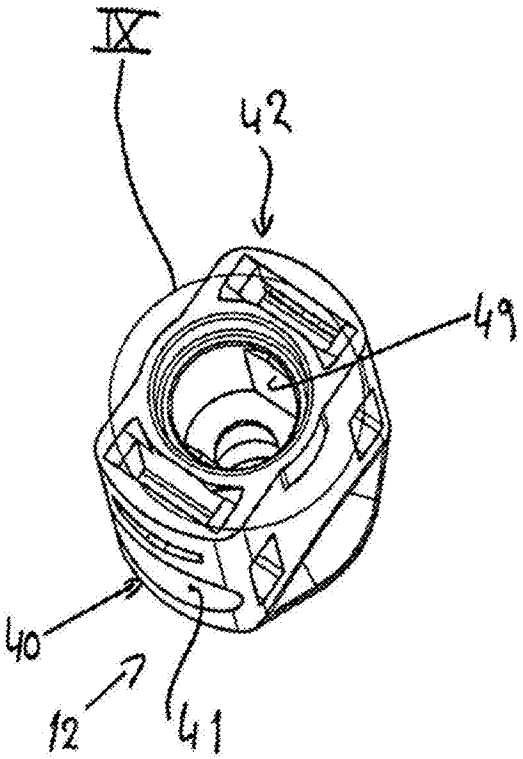
FIG. 9 is an alternative view of the socket shown in FIG.
Figure 17:
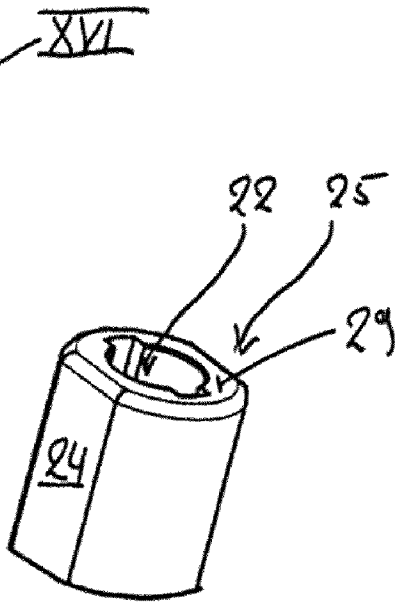
Fig. 17 Prior Art
FIG. 17 is a large-scale view of the detail indicated at circle XVI in FIGS. 16.
Figure 16:
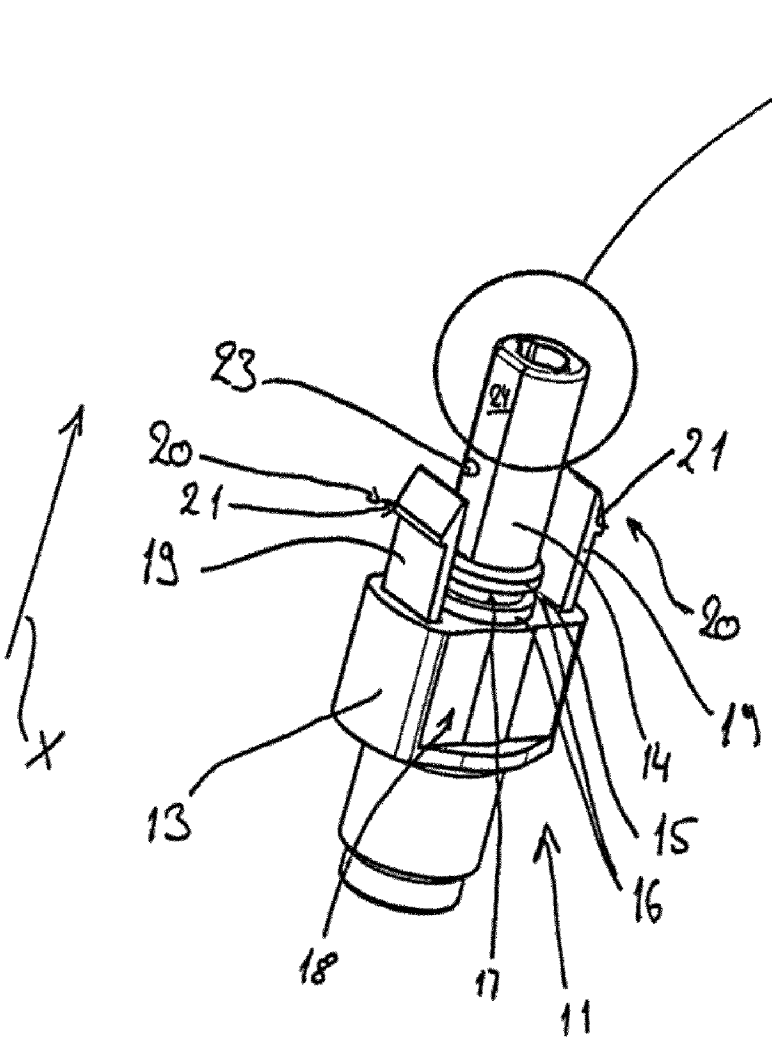
Fig. 16 Prior Art
FIG. 16 shows a plug of a plug-type prior-art connector.

FIGS. 3 and 4 are analogous to FIGS. 16 and 17 and show the plug 11 in an overall view, as well as the outer end 25 of the contact holder 14 of the plug 11 in a large-scale view. Identically functioning components of the plug 11 shown in FIG. 3 with the plug 11 of the prior art according to FIG. 16, have been provided with the same references.

Particular attention is to be paid to the contact holder 14 in the plug 11 that is modified in accordance with the invention. In its essentially cylindrical form and in its basic geometry, it is like the contact holder 14 of the prior art and consequently also has a cut-out 23. As a result, the contact holder 14 in FIGS. 3 to 6 also is formed with a pair of secantal faces 24 that point toward the snap-in tongues 19 and extend along the entire length of the contact holder 14.

Contrary to the prior art, the contact holder outer end 25, however, is significantly changed. Outer-surface regions 26 between the cut-outs 23 or the secantal faces 24 they form have been provided with guide formations 27. As the result of a partial material removal in the contact holder outer end 25, the outer-surface regions 26 form to the plug-in direction x or to the longitudinal plug-connector axis L diametrally opposite aligned pairs of angled guide edges 28. These extend approximately in the transition section between the secantal faces 24 and run arrow-like or roof-like toward each other in the plug-in direction x. Each angled pair of guide edges 28 of each outer-surface region 26 meets to form at the contact holder front end face 29 an intersection 30 that is offset angularly by about 90° to the secantal faces 24.

FIGS. 7 to 10 show the socket 12 in accordance with the invention in various views or sectional enlargements. Even the socket 12 in accordance with the invention is designed identical to socket 12 of the prior art in its essential components according to FIGS. 18 and 19.

As a first important difference it is striking that in the socket 12 according to the invention, snap-seat side walls 53 extend continuously up to the level of the snap slot 46 and form therewith the sides of a snap seat 54. This has the important advantage that the previous manual engagement in the snap slots 46 is no longer possible and the snap connection between the plug 11 and socket 12 can only still be worked on with tools. In order to make manual actuation even more difficult, a window 55 has been provided outside the snap unit seat 54 to make the engagement opening 56 even smaller.

Like the socket 12 already known from the prior art, the socket according to the invention 12 as per FIGS. 7 to 10 has the two diametrally opposite insets 49 in the seat 48, which form the secantal faces 50 in the cylindrical cross section. These faces 50 extend in the plug-in direction x along the entire length of the seat 48. The contact-holder seat 45 or the seat 48 of the socket in accordance with the invention thus corresponds in its essential geometry to the socket 12 of the prior art.

The only change on the socket, which is, however, essential for the invention, concerns the front end faces 51 of the insets 50 [49]. Whereas they are flush with the front end face 52 of the socket in the prior art, in accordance with the invention they now form opposite guide formations 57 that cooperate with the guide formations 27 of the contact holder.

These guide formations 57 are designed as opposite angled edges 58 according to the invention. These are aligned diametrally oppositely to the longitudinal plug-connector axis L and form a V-shape pointing in the plug-in direction x. The apex formed by the V-shaped angled edges 58 is level with a shoulder 59 formed at the cross section reduction from the sealing section 47 to the seat 48 the of contact-holder seat 45, i.e. at the end of the seat 48. In FIGS. 11 to 15, the process of plugging the plug 11 into the socket 12 is shown. This shows clearly how, with the help of the angled guide edges 28 and opposite angled edges 58, automatic alignment of the secantal faces 24 and 50 is achieved in the plug-in process.

Figure 11:
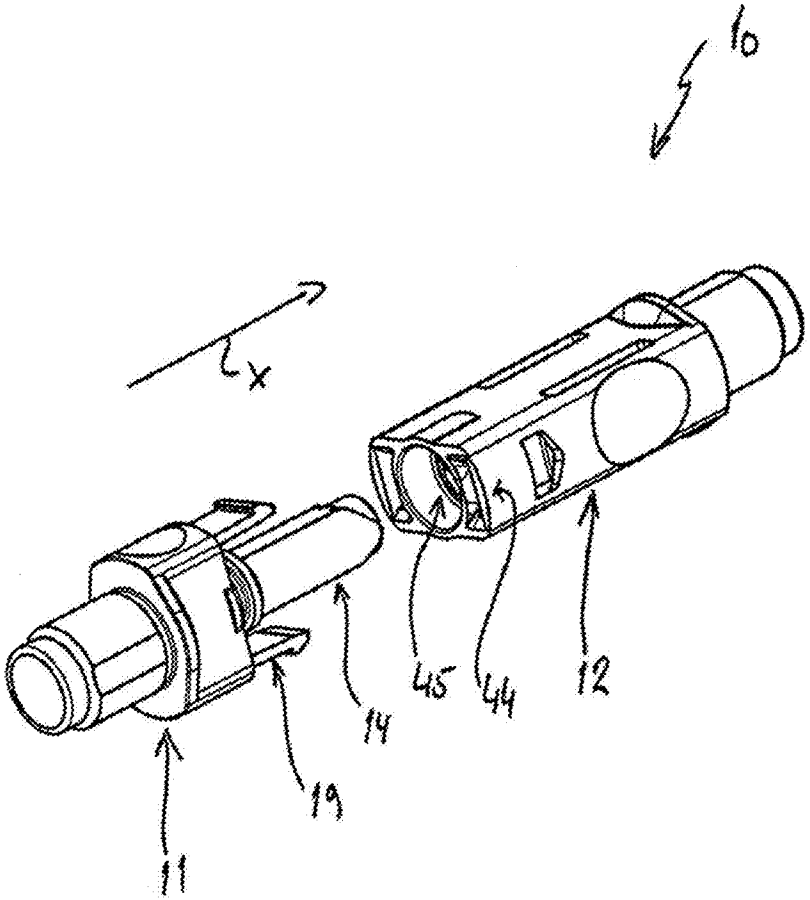
FIG. 11 shows a plug-type connector according to FIG. 2 with snap units offset by 90° with respect to each other on the plug and socket.

In FIG. 11, the beginning of the insertion process is illustrated. The plug-in tongues 19 of plug 11 are angularly offset by approximately 90° with respect to the snap seats 44. This alignment corresponds approximately to the illustration in FIG. 20 of the prior art, in which the insertion process was previously blocked in order to prevent snap-in and thus an unsafe plug-in connection of plug 11 and socket 12.

Figure 12:
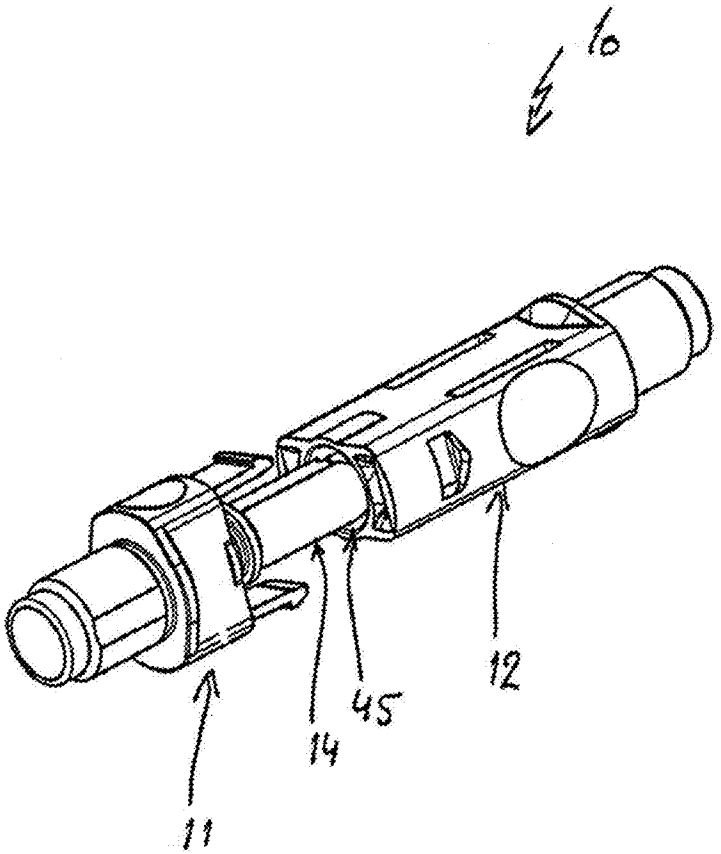
FIG. 12 shows the starting plug-in process with snap units offset with respect to each other by 90° on the plug and socket according to FIG. 11.

In FIG. 12, the contact holder 14 is already partially inserted into the contact-holder seat 45.

Figure 15:
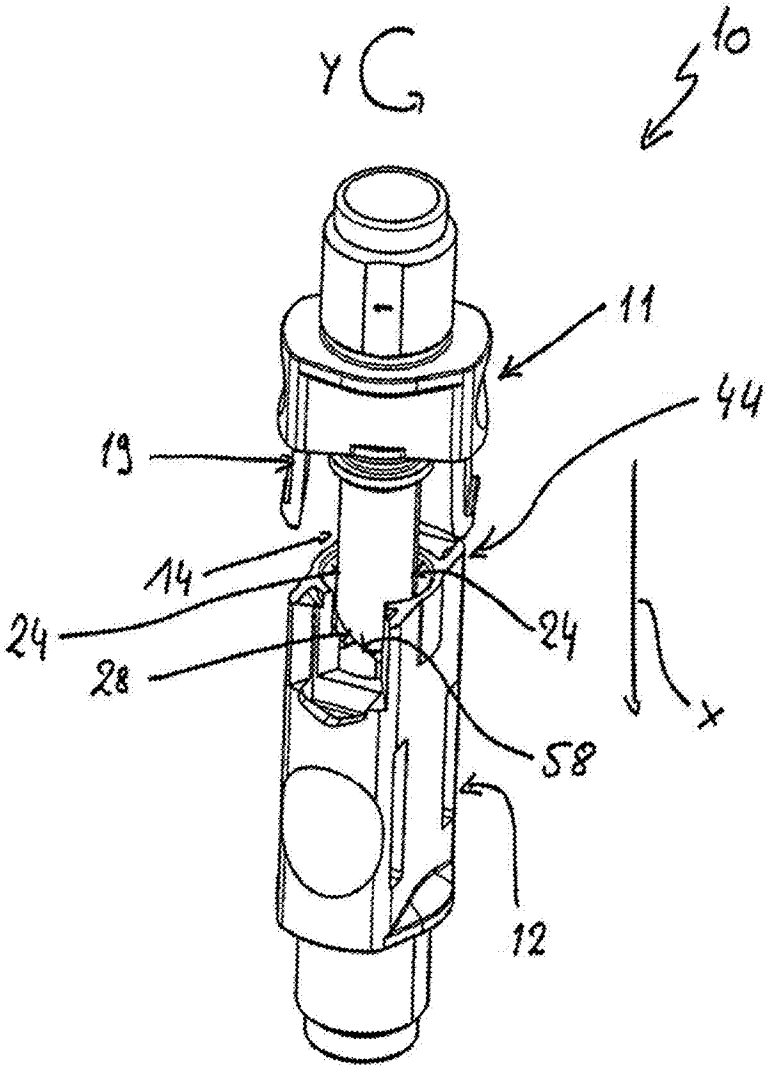
FIG. 15 shows a plug-type connector according to FIG. 12 with a socket graphically opened up to permit a view of the positioning means.

FIG. 15 shows the plug-condition of FIG. 12. The snap-in seat 44 of socket 12 that is turned toward the observer is broken away in the drawing. Thus, one can see the unreferenced contact-holder seat 45. In contrast to the prior art, according to FIG. 15, planar faces do not abut each other approximately parallel to the front end face of socket 52 or the contact-holder front end face 29 and stop the insertion movement. Instead, the now angled guide edges 28 and opposite angled edges 58 meet and engage thread-like. As a consequence, the plug rotates around the longitudinal plug-type connector axis L toward rotation y, which is not shown in FIG. 15, until the secantal faces 24 and 50 on the plug and on the socket are aligned with each other. As a result, the snap formation 19 and 44 of plug 11 and socket 12 are also aligned toward each other in the plug-in direction x and are thus aligned axially with each other. Nothing impedes further insertion movement in the plug-in direction x.

In FIG. 15, the advantage of the diametrally opposed pairs of angled guide edges and angled opposite faces 28, 59 can be seen. Depending on which pair of faces meet each other, the insertion movement also leads to a rotation counter to the direction of rotation y. Thus, the shortest rotating motion is always executed to ensure the correct positioning of the plug 11 and socket 12.

When the inset 49 and the outer-surface region 26 form the two angled guide edges 28 or angled opposite faces 58, they meet at a point. It is advantageous to locate the points of two angled guide edge pairs 28 or two angled opposite faces 58 at least minimally circumferentially asymmetrical on the contact holder 14 or in the seat 48. This ensures that the angled edges 28, 58 always meet each other in a plug-in process, but never the points, so that the required rotation that is required for positioning plug 11 and socket 12 is always induced.

Figure 14:
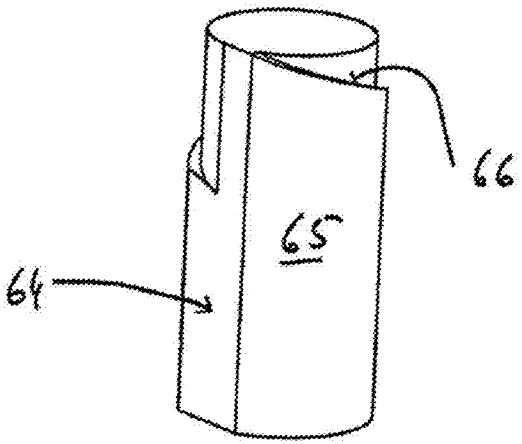
FIG. 14 shows a simplified contact holder on the plug according to FIG. 13 in alternative view.
Figure 13:
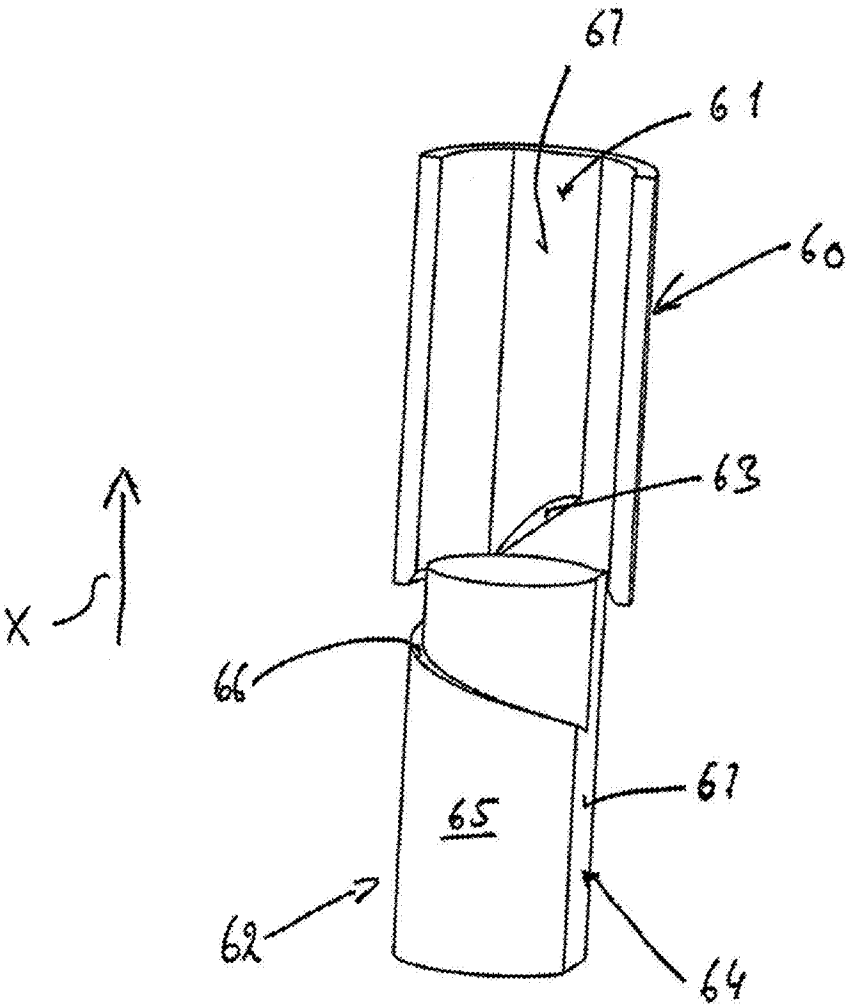
FIG. 13 is a schematic illustration of a contact holder on the plug and a contact-holder seat on the socket in alternative, simplified embodiment.

In order to make the plug-in process visually clear once more, FIGS. 13 and 14 show schematic representations of an alternative embodiment of simplified construction.

A cylindrical contact holder sleeve 60 has a single bar-like radially inwardly projecting inset 61 with an angled face 63 that is directed axially toward the schematically shown contact holder 62.

The contact holder 62 has a cut-out 64 inset from an outer-surface region 65 and forming an angled guide edge 66 directed axially toward the contact-holder sleeve 60. Based on its longitudinal extension alone, the similarity with a thread section is clear. The inset 61 and cut-out 64 form, as already described, complementary secantal faces 67. The angled guide edge 66, which extends from the contact holder front end face 68 opposite the plug-in direction x, is formed by machining of contact holder 42 [62] to a thickness equal to the maximum thickness of inset 61. This is also analogous to the previous embodiment.

If now, during the plug-in process the angled guide edge 66 meets the angled opposite face 63, the contact holder 62 then rotates around its own axis until the secantal faces 67 of the contact holder 62 and the contact-holder sleeve 60 are axially aligned with each other and the necessary position has been reached.

In sum, the principle of the invention can be abstracted to the effect that at least one of the positioning means of the plug 11 or socket 12 (here the inset 49 or 67) is provided with a guide formation that works together with an opposite guide formation that is located complementarily in the socket 12 or plug 11.

The interaction of the guide formations leads to an automatic alignment of the positioning means of the plug and the socket during the plug-in process. In contrast to the prior art, this has the important advantage that the installer does not have to actively rotate the plug 11 or socket 12 until they are positioned correctly toward each other and can be plugged into each other, but only simply needs to perform the plug-in process. The specific embodiment in FIGS. 1 to 12 and 15 was provided with guiding sections in such a way that it is plug-compatible with the prior art shown in FIGS. 16 to 21. This has the important advantage that during service, maintenance or expansion of existing solar plants, a uniform plug system continues to exist, even if in mixed use of plugs 11 or sockets 12 in accordance with the invention together with prior-art plugs 11 or sockets 12, the advantages according to the invention are not necessarily realized. A socket 12 that is designed according to the invention makes it possible, even in connection with a prior-art plug 11 to induce the advantageous rotating motion for positioning, even if because of the sloped guide edges 28 that are absent on the plug, the rotating motion y is not induced in every relative position of plug 11 and socket 12.

The invention claimed is:

1. A plug-type connector comprising:

a plug member having a contact holder centered on an axis;

a socket member formed with a seat generally complementary to the contact holder and in which the contact holder is axially fittable;

axially extending coding formations on the members and radially interfitting in only one relative angular position of the members when the members are fitted axially together;

snap formations on the members lockingly engageable with each other only in the one angular position when the members are fitted axially together to lock the members axially together; and axially engageable guide formations on the members, at least one of the guide formations extending at an acute angle to a plane perpendicular to the axis, the formations being so oriented that, when the members are axially aligned but are not in the one position and are moved axially together, they axially engage, relatively rotate the members into the one angular position, and then can axially pass each other.

2. The plug-type connector defined in claim 1 wherein the snap formations include an axially extending and radially elastically deformable tongue on one of the members having an end barb and a radially open seat on the other of the member in which the barb is received when the members are fitted axially together.

3. The plug-type connector defined in claim 1 wherein the recess is formed in the contact holder and is a flat having a planar secantal face and the projection is an inset formed in the seat and having a planar secantal face substantially fittable with the face of the flat when the contact holder is engaged axially in the seat.

4. A plug-type connector comprising a plug having a grip, at least one snap formation effective in a plug-in direction, and a generally cylindrical contact holder projecting out of the grip in the plug-in direction, and a socket having a grip forming a generally cylindrical contact-holder seat into which the contact holder is engageable with a fitting tolerance and an opposite snap formation that cooperates with the one snap formation and that together with the one snap formation secures the plug and the socket in a plugged-in condition, the contact holder and the contact-holder seat being formed with complementary positioning formations that make insertion of the plug into the socket only possible when the one snap formation is in an aligned position aligned with the opposite snap formation, the positioning formation of the contact-holder seat being an inset extending in the plug-in direction and projecting into the seat, the positioning formation of the contact holder being a cut-out complementary to the projecting inset, the cut-out and inset being aligned in the direction in the aligned position, one of the positioning formations of the plug or socket being provided with a guide formation that works together with an opposite guide formation of the socket or plug so that during the plug-in process the plug and socket are forced to rotate relative to each other to assume the aligned position of the positioning formations, the inset forming a secantal face with respect to the contact-holder seat and the cut-out forming a secantal face with respect to the contact holder and for positioning of the one snap formation and the opposite snap formation the secantal faces of contact holder and contact-holder seat face each other.

5. A plug-type connector comprising a plug having a grip, at least one snap formation effective in a plug-in direction, and a generally cylindrical contact holder projecting out of the grip in the plug-in direction, and a socket having a grip forming a generally cylindrical contact-holder seat into which the contact holder is engageable with a fitting tolerance and an opposite snap formation that cooperates with the one snap formation and that together with the one snap formation secures the plug and the socket in a plugged-in condition, the contact holder and the contact-holder seat being formed with complementary positioning formations that make insertion of the plug into the socket only possible when the one snap formation is in an aligned position aligned with the opposite snap formation, the positioning formation of the contact-holder seat being an inset extending in the plug-in direction and projecting into the seat, the positioning formation of the contact holder being a cut-out complementary to the projecting inset, the cut-out and inset being aligned in the direction in the aligned position, one of the positioning formations of the plug or socket being provided with a guide formation that works together with an opposite guide formation of the socket or plug so that during the plug-in process the plug and socket are forced to rotate relative to each other to assume the aligned position of the positioning formations, the inset having a front end face that confronts the contact holder, that is provided with a sloping angled opposite face in the plug-in direction, the outer-surface region bordering on the at least one cut-out being provided with an angled guide edge, the angled guide face and the opposite angled edge working together in the plug-in process like a thread to force the plug and the socket to rotate relative to each other to the aligned position of the inset and the cut-out.

6. A plug-type connector comprising a plug having a grip, at least one snap formation effective in a plug-in direction, and a generally cylindrical contact holder projecting out of the grip in the plug-in direction, and a socket having a grip forming a generally cylindrical contact-holder seat into which the contact holder is engageable with a fitting tolerance and an opposite snap formation that cooperates with the one snap formation and that together with the one snap formation secures the plug and the socket in a plugged-in condition, the contact holder and the contact-holder seat being formed with complementary positioning formations that make insertion of the plug into the socket only possible when the one snap formation is in an aligned position aligned with the opposite snap formation, the positioning formation of the contact-holder seat being an inset extending in the plug-in direction and projecting into the seat, the positioning formation of the contact holder being a cut-out complementary to the projecting inset, the cut-out and inset being aligned in the direction in the aligned position, one of the positioning formations of the plug or socket being provided with a guide formation that works together with an opposite guide formation of the socket or plug so that during the plug-in process the plug and socket are forced to rotate relative to each other to assume the aligned position of the positioning formations, the contact-holder seat being provided with of the two positioning formations located with respect to each other angularly offset by approximately 180° in the form of insets that work together with corresponding cut-outs of contact holder.

7. The plug-type connector according to claim 6 wherein each inset is provided with a front end face that confronts the contact holder, that is provided with two opposite angled edges oriented roof-shaped toward each other in the opposite direction to the plug-in direction, with opposite angled edges that slope in the plug-in direction and that each outer-surface region bordering on at least one cut-out on the contact-holder seat is provided with two angled guide edges that are oriented arrow-like toward each other in the plug-in direction, and respectively one angled guide edge and one opposite angled edge work together thread-like in the plug-in process to force the plug and socket to rotate relative to each other up to the aligned position of the inset and the cut-out.

8. The plug-type connector defined in claim 3 wherein the inset has an end face forming the one angled guide formation.

9. The plug-type connector defined in claim 1 wherein the coding formations are an axially extending radial projection on one of the members and a generally complementary radial recess on the other of the members, the projection fitting in the recess only in the one angular position.

10. The plug-type connector defined in claim 8 wherein the angled guide formation is a pair of straight edges forming an axially directed point.

11. The plug-type connector defined in claim 8 wherein the other of the guide formations is an end face of another inset formed on the contact holder.

12. The plug-type connector defined in claim 11 wherein the other guide formation is a pair of straight edges forming an axially directed point.

13. The plug-type connector defined in claim 11 wherein the insets can only pass each other axially in the one angular position on axial fitting-together of the members.

* * * * *